US006218963B1

(12) United States Patent
Kawanabe et al.

(10) Patent No.: US 6,218,963 B1
(45) Date of Patent: Apr. 17, 2001

(54) TIME MANAGEMENT SYSTEM FOR PASSING VEHICLES

(75) Inventors: Toshihiro Kawanabe, Hitachi; Satoru Kayukawa; Masanari Nozato, both of Hitachinaka; Yasuo Shimizu; Takayuki IIno, both of Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/526,012

(22) Filed: Mar. 15, 2000

(30) Foreign Application Priority Data

Sep. 7, 1999 (JP) ..... 11-252494

(51) Int. Cl.[7] ..... G08G 1/01

(52) U.S. Cl. ..... 340/933; 340/928; 340/960; 235/384; 701/117

(58) Field of Search ..... 340/933, 936, 340/928, 940; 235/384; 701/117

(56) References Cited

U.S. PATENT DOCUMENTS

| | | | | |
|---|---|---|---|---|
| 5,310,999 | * | 5/1994 | Claus et al. | 235/384 |
| 5,485,520 | * | 1/1996 | Chaum et al. | 340/825.31 |
| 5,581,249 | | 12/1996 | Yoshida | 340/928 |
| 5,684,475 | * | 11/1997 | Krause et al. | 340/934 |
| 5,933,096 | * | 8/1999 | Tsuda | 340/928 |
| 5,952,940 | * | 9/1999 | Matsumoto | 340/905 |
| 6,078,895 | * | 6/2000 | Ryu et al. | 340/933 |

FOREIGN PATENT DOCUMENTS

| | | |
|---|---|---|
| 0 694 883 | 1/1996 | (EP) . |
| 1 462 055 | 1/1977 | (GB) . |

OTHER PUBLICATIONS

Patent Abstracts of Japan, vol. 018, No. 429, Aug. 10, 1994 & JP 06 131590 A (Sharp Corp.; Others) May 13, 1994.

* cited by examiner

*Primary Examiner*—Benjamin C. Lee
*Assistant Examiner*—Daniel Previl
(74) *Attorney, Agent, or Firm*—Kenyon & Kenyon

(57) ABSTRACT

When a vehicle enters a tollhouse and is detected with a vehicle detector, a fixed station transmits a communication link request to a mobile station of the vehicle via an antenna to thereby start transferring toll transfer information between the fixed station and mobile station. During a predetermined release timer time after the communication completion, the communication between the mobile station and fixed station is inhibited, and the mobile station can resume communication upon reception of the communication link request from the fixed station after the lapse of the release timer time. The passing time of the vehicle passing a section between the vehicle detector and another vehicle detector is measured at the fixed station to update the release timer time in accordance with the passing times of vehicles.

8 Claims, 4 Drawing Sheets

TIME MANAGEMENT SYSTEM FOR PASSING VEHICLES

BACKGROUND OF THE INVENTION

The present invention relates to a passing vehicle time management system, and more particularly to a passing vehicle time management system suitable for the time management of vehicles passing a tollhouse on a toll road or the like by using communication units.

In a conventional system, a driver (user) of a vehicle running on a toll road or the like receives a road ticket from a toll collector or an automatic ticket dispenser at the tollhouse, and after the driver reaches the target exit, the driver pays the toll at the tollhouse directly to the toll collector or automatic toll receiving machine. For the toll transfer process at the tollhouse on a toll road or the like, the toll corresponding to each road ticket is checked for each vehicle and the same vehicle is not incurred the toll twice. With such a system, however, it takes a time to process the toll transfer so that traffic congestion may occur at the tollhouse.

To solve such problems, an automatic toll transfer system has been adopted. This automatic toll transfer system incorporates the configuration that a fixed station serving as a fixed communication unit is provided at a tollhouse on a toll road or the like, a vehicles running along the toll road is equipped with a mobile station serving as a mobile communication unit, and the toll is automatically transferred by exchanging information on the toll transfer between the fixed station and mobile station through wireless communications. For example, in this system, information on an entrance tollhouse and an exit tollhouse, information on a toll transfer and the like are exchanged through wireless communications, and the toll is calculated at the fixed station and incurred to the bank account or the like of a user (driver). Manual toll calculation and charge process are therefore unnecessary and the man power can be reduced. Still more, a time zone is set during which the communications from the mobile station to the fixed station is inhibited for a predetermined time (release timer time) after the toll transfer information is exchanged between the mobile and fixed stations. Therefore, during the predetermined time after the communication completion, it is possible to prevent the fixed station from issuing a communication link request to the mobile station and executing a charging process twice.

The conventional automatic toll transfer system, however, does not consider the case wherein a vehicle in an area communicable with the fixed station may stay long because of traffic congestion. If the vehicle stays in the area communicable with the fixed station after the mobile station mounted on the vehicle exchanges the toll transfer information with the fixed station, there is a possibility that after the predetermined time after the completion of communications with the fixed station, i.e., after the release timer counts up, the mobile station may respond to a communication link request from the fixed station and resume communications. In such a case, unnecessary communications are performed between the mobile and fixed stations and the communications may become congested. Furthermore, as the communications between the mobile and fixed stations resume, there is a possibility that the charging process for incurring the toll is executed twice for the same vehicle.

SUMMARY OF THE INVENTION

An object of the invention is to provide a passing vehicle time management system capable of dynamically setting a release timer time in accordance with a vehicle passing time or speed which is used as a traffic flow index, and preventing communication congestion to be otherwise caused by the running states of vehicles.

In order to achieve the above object, the invention provides a time management system for passing vehicles using a passing time of a vehicle as a traffic flow index. The time management system comprises: mobile communication means mounted on a vehicle; fixed communication means for transferring toll transfer information to and from the mobile communication means mounted on the vehicle when the vehicle enters a communicable area; passing time measuring means for measuring a passing time of the vehicle passing a vehicle measuring section partially including a road belonging to the communicable area; and timer time setting means for setting a release timer time in accordance with a value measured by the passing time measuring means and adding the set release timer time to the toll transfer information, the release timer time indicating a communication inhibition time after completion of transfer of the toll transfer information, wherein the mobile communication means stops communication with the fixed communication means for the release timer time added to the toll transfer information after the completion of transfer of the toll transfer information to and from the fixed communication means, even if a communication link request is received from the fixed communication means.

The invention also provides a time management system for passing vehicles using a passing speed of a vehicle as a traffic flow index. The time management system comprising: mobile communication means mounted on a vehicle; fixed communication means for transferring toll transfer information to and from the mobile communication means mounted on the vehicle when the vehicle enters a communicable area; passing speed measuring means for measuring a passing speed of the vehicle passing a vehicle measuring section partially including a road belonging to the communicable area; and timer time setting means for setting a release timer time in accordance with a value measured by the passing speed measuring means and adding the set release timer time to the toll transfer information, the release timer time indicating a communication inhibition time after completion of transfer of the toll transfer information, wherein the mobile communication means stops communication with the fixed communication means for the release timer time added to the toll transfer information after the completion of transfer of the toll transfer information to and from the fixed communication means, even if a communication link request is received from the fixed communication means.

In each of the passing vehicle time management systems, the fixed communication means may be means having a function of transferring toll transfer information to and from the mobile communication means mounted on the vehicle when the vehicle enters one of a plurality of divided communicable areas, and the passing time measuring means or passing speed measuring means may be means having a function of measuring a passing time or speed of the vehicle passing a vehicle measuring section partially including a road belonging to each of the plurality of divided communicable areas.

In each of the passing vehicle time management system, the following feature may be added.

The fixed communication means starts the transfer of the toll transfer information to and from the mobile communication means mounted on the vehicle and judges that communication is duplicate communication to a same vehicle in the communicable area, the fixed communication means forcibly stops the communication with the same vehicle.

With the above-described means, the release timer time is set in accordance with the measured passing time or speed of the vehicle passing the vehicle measuring section. Accordingly, if the vehicle passing time prolongs or the vehicle passing speed lowers because of the traffic congestion, the release timer time prolongs. It is therefore possible to prevent communication congestion to be caused by unnecessary communications between the mobile communication means and fixed communication means after the completion of exchange of the toll transfer information between the mobile communication means and fixed communication means, and to prevent the process of charging a toll to the same vehicle twice.

If duplicate communication is performed with the same vehicle in the communicable region after the predetermined time after the completion of transfer of the toll transfer information between the mobile communication means mounted on the vehicle and the fixed communication means, the communication with the same vehicle is forcibly stopped. It is therefore possible to reliably prevent the duplicate toll charging process to the same vehicle.

DESCRIPTION OF THE EMBODIMENT

Figure 1:
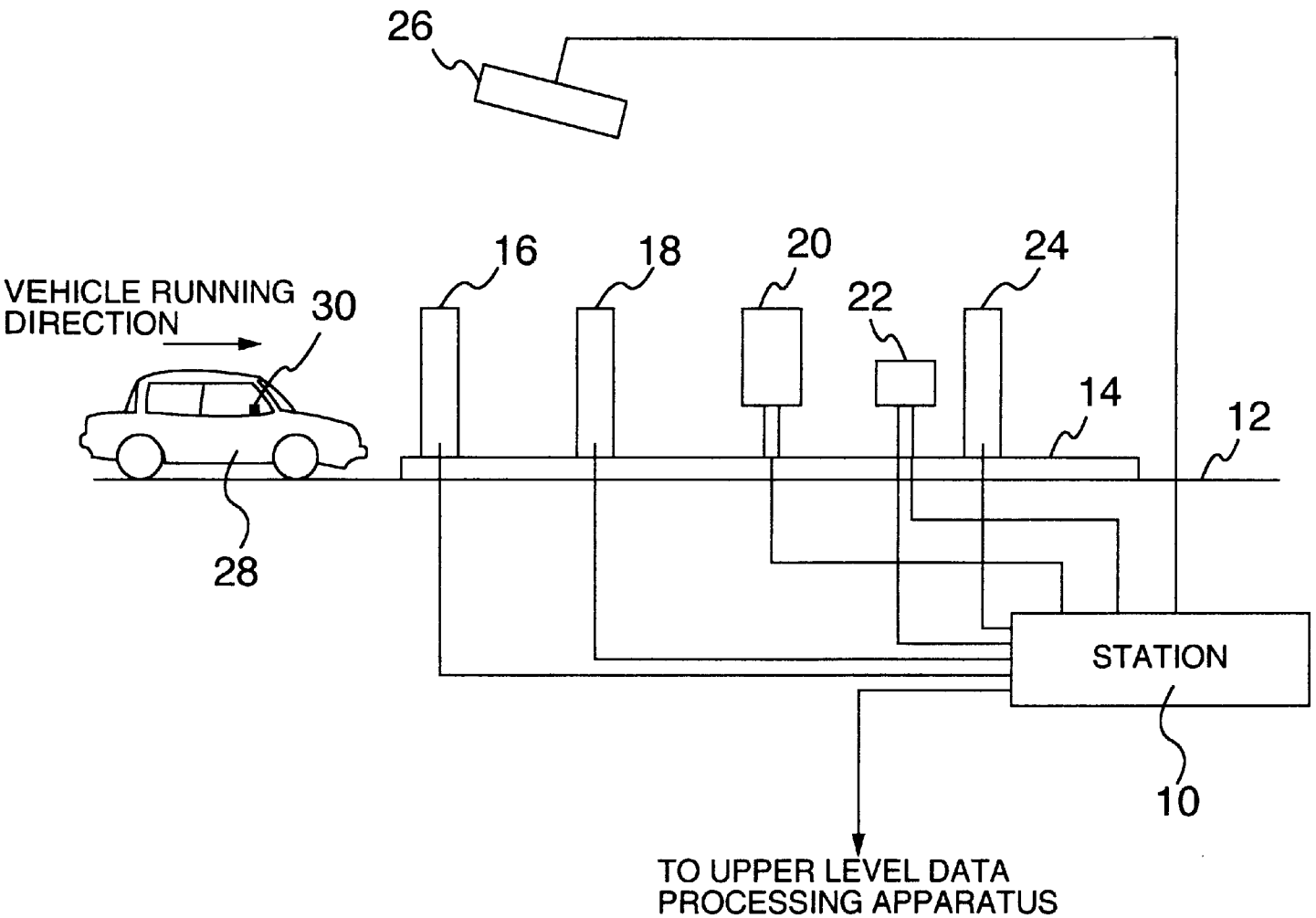
FIG. 1 shows the overall configuration of a system according to an embodiment of the invention.

An embodiment of the invention will be described with reference to the accompanying drawings. FIG. 1 shows the overall configuration of a system according to an embodiment of the invention. Referring to FIG. 1, a fixed station 10 is installed at a tollhouse on a superhighway or the like, and a tollhouse island 14 is disposed along a road 12. Along the tollhouse island 14, vehicle detectors 16 and 18, a road display device 10, a departure control machine 22, and a vehicle detector 24 are dispsersively disposed in this order from the entrance side. A tollhouse antenna 26 is disposed above the vehicle detector 18. The vehicle detectors 16 and 18, road display device 10, departure control machine 22, vehicle detector 24 and antenna 26 are electrically connected to the fixed station 10 which is connected to an upper level data processing apparatus. A vehicle 28 running on the road 12 is equipped with a mobile station 30 serving as a mobile communication unit.

The fixed station 10 serves as a fixed communication unit together with the antenna 26, and also serves as a passing time measuring unit or a passing speed measuring unit, and as a timer setting unit, together with the vehicle detectors 16 and 24.

Figure 2:
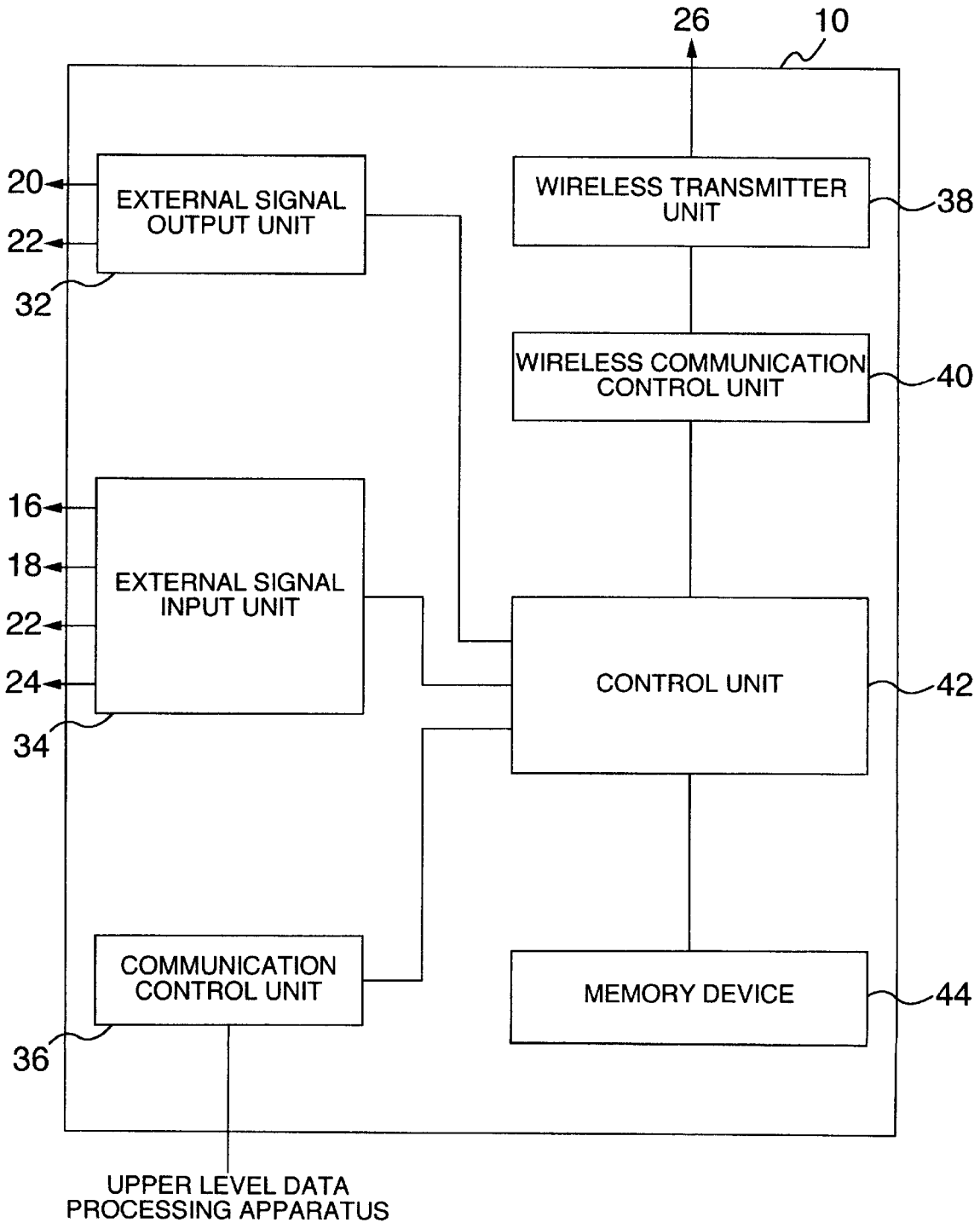
FIG. 2 is a block diagram showing the structure of a fixed station.

More specifically, as shown in FIG. 2, the fixed station 10 has an external signal output unit 32, an external signal input unit 34, a communication control unit 36, a wireless transmitter unit 38, a wireless communication control unit 40, a control unit 42, and a memory unit 44. The external signal output unit 32 is connected to the display device 20 and departure control machine 22. The external signal input unit 34 is connected to the vehicle detectors 16 and 18, departure control machine 22 and vehicle detector 24. the communication control unit 36 is connected to an upper level data processing apparatus. The wireless transmitter unit 38 is connected to the tollhouse antennal 26. The control unit 42 has a built-in timer. The memory unit 44 stores data related to a release timer time and a vehicle passing time management table.

The tollhouse antenna 26 transmits information supplied from the fixed station 10 in a predetermined area in the form of radio waves. The vehicle detectors 16 and 18 are installed at opposite ends of a communicable area allowing information exchange between the mobile station 30 mounted on the vehicle 28 and the antenna 26 through wireless communications. Namely, the vehicle detector 16 detects that the vehicle 28 enters the communicable area of the tollhouse, and supplies this detection signal to the fixed station 10. The vehicle detector 18 detects that the vehicle 28 enters the communicable area exits this area, and supplies this detection signal to the fixed station 10. By using as a trigger the detection signal supplied from the vehicle detector 16, the fixed station 10 starts exchanging the toll transfer information with the mobile station, and by using as a trigger the detection signal supplied from the vehicle detector 18, the fixed station 10 operates to display the process result on the display device 20.

As the detection signal is input from the vehicle detector 16 to the fixed station 10, this detection signal is input via the external signal input unit 34 to the control unit 42. The control unit 42 executes a vehicle tollhouse entrance/exit management (entrance) process as a process of giving an entered vehicle process ID and a current time, and stores this process result in the memory unit 44. In addition, by using as a trigger the detection signal of the vehicle detector 16, the fixed station 10 transmits information to the mobile station 30 via the wireless communication control unit 40, wireless transmitter unit 38 and antenna 26. The information includes: the toll transfer information such as entrance information (tollhouse name) and subscriber information (bank account of the drive of the vehicle 28); and information on a release timer time indicating a communication inhibition time after the completion of exchange of the toll transfer information with the mobile station 30. After the completion of necessary information exchange between the fixed station 10 and mobile station 30, the mobile station 30 executes a process of inhibiting to resume communications for a predetermined time after the communication completion of the toll transfer information, i.e., during the release timer time.

As the vehicle 28 further runs and is detected with the vehicle detector 18, this detection signal is input to the fixed station 10. This detection signal is supplied via the external signal input unit 34 to the control unit 42. By using as a trigger the detection signal from the vehicle detector 18, the control unit 42 operates to display a toll calculation result, a passing permission/denial judgement result and the like on the display device 20 via the external signal output unit 32. The control unit 42 further operates to open or close the departure control machine 22 via the external signal output unit 32, in accordance with the passing permission/denial judgement result. For example, if the passing of the vehicle 28 is to be denied, the departure control machine 22 is controlled to lower a passing denial bar to prevent the passing of the vehicle 28. During the opening operation of the departure control machine 22, the vehicle 28 continues running and when it is detected with the vehicle detector 24, this detection signal is input via the external signal input unit 34 to the control unit 42. In this case, the control unit 42 operates to erase the data related to the vehicle 28 and displayed on the display device 20, to close the departure control machine 22, and to execute a vehicle tollhouse entrance/exit (exit) process. In this manner, after the toll transfer information exchange between the mobile station 30 and fixed station 10 is completed while the vehicle 28 continues running along the tollhouse, the release timer time lapses. Thereafter, the mobile station 30 mounted on the vehicle 28 can start communicating with another fixed station at the next tollhouse, upon reception of a communication link request.

The release timer time for the vehicle 28 is set by considering the running states of other vehicles. For example, if it takes a long time for the vehicle to pass the tollhouse because of traffic congestion, the fixed station 10 sets a longer release timer time to each vehicle in accordance with an average of passing times of other vehicles, as will be later described. It is therefore possible to prevent the fixed station 10 from issuing the communication link request to the mobile station 30 in the communicable area, after the lapse of the release timer time. Even if a longer release timer time is set, the mobile station 30 of the vehicle 28 in the communication area can receive the communication link request from the fixed station 10 after the lapse of the release timer time, depending upon the traffic congestion. In view of this, according to the embodiment, if the mobile station 30 in the communicable area receives a communication link request from the fixed station 10 after the lapse of the release timer time, although the communication starts once, this communication with the mobile station is forcibly stopped by the process of the control unit 42 of the fixed station 10. Namely, if the mobile station 30 in the communicable area receives a communication link request from the fixed station 10 after the lapse of the release timer time, although the communication starts once, during this communication start period, information is exchanged between the fixed station 10 and mobile station 30, for example, the information including cryptography information used by the vehicle 28 and vehicle-mounted unit information (e.g., information for identifying the vehicle). The vehicle-mounted unit information transmitted from the mobile station 30 to the fixed station 10 contains a vehicle-mounted unit ID for identifying the vehicle. The control unit 42 checks this vehicle-mounted unit ID. If the vehicle 28 having this vehicle-mounted unit ID does not still exit from the tollhouse, it is judged that the communication with the vehicle 28 is duplicate, and the communication with the mobile station 30 is forcibly stopped. With this process, it is possible to prevent duplicate toll charging to the same vehicle 28 and to prevent communication congestion.

Figure 3:
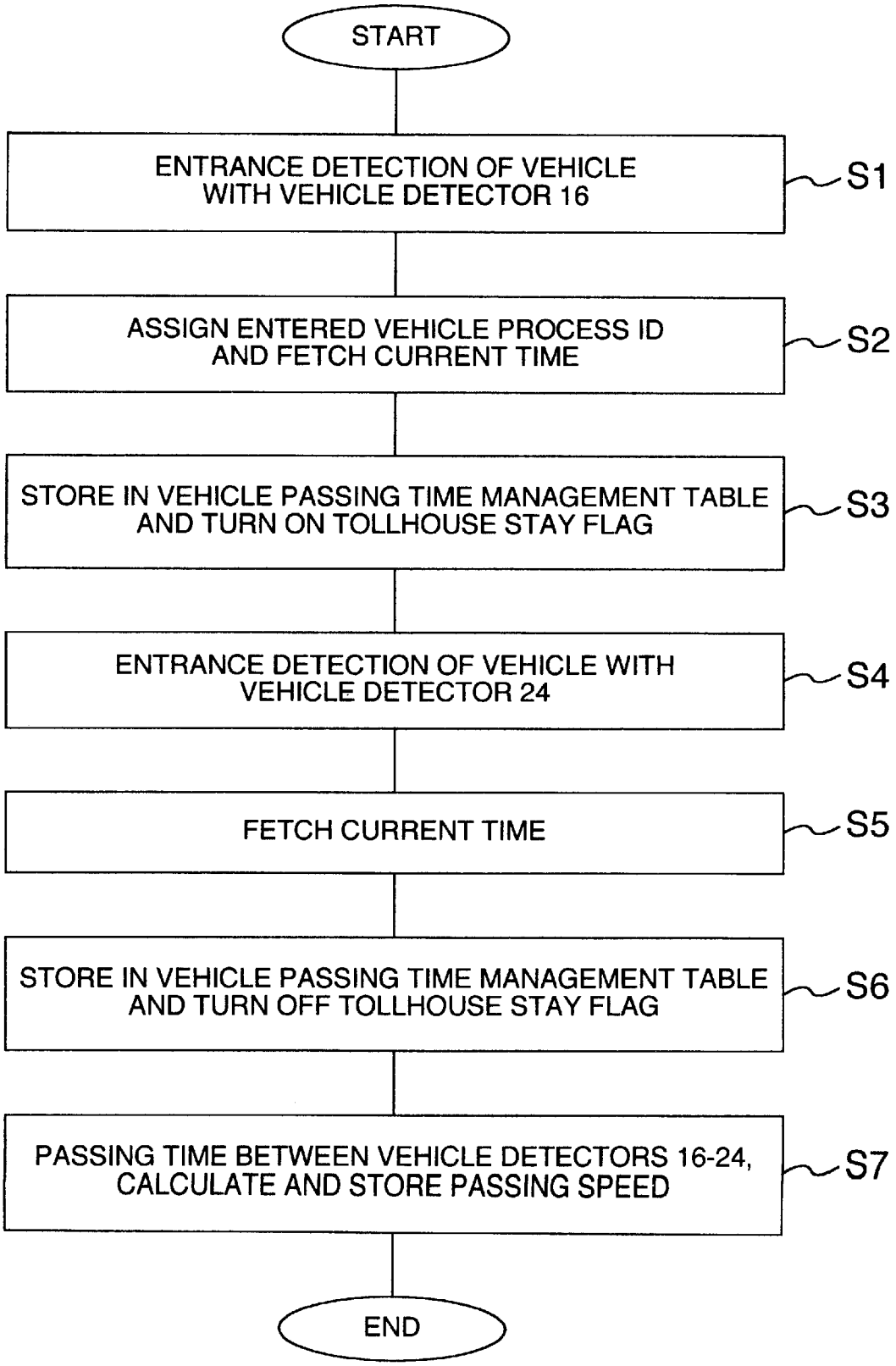
FIG. 3 is a flow chart illustrating a method of updating a release timer value.
Figure 4:
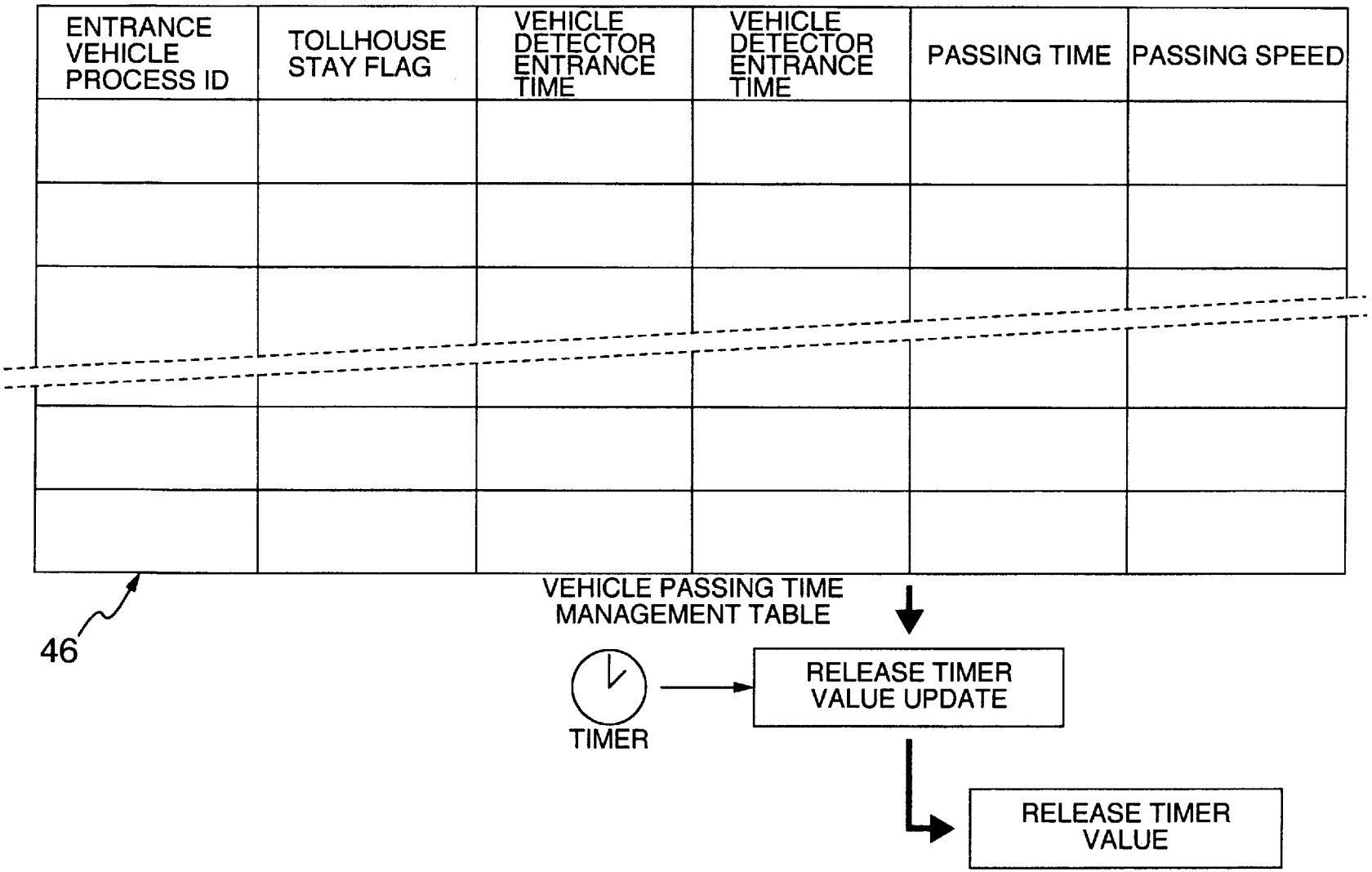
FIG. 4 is a diagram showing the structure of a vehicle passing time management table.

Next, a method of setting the release timer value will be described with reference to FIGS. 3 and 4.

First, as the vehicle 28 enters the tollhouse and the entrance of the vehicle 28 is detected with the vehicle detector 16 (step S1), the control unit 42 determines the entered vehicle process ID for identifying the vehicle 28 and fetches the entered vehicle process ID and current time (Step S2), thereafter stores this data in a vehicle passing time management table 44 in the memory unit 44, and turns on a tollhouse stay flag while the vehicle 28 stays at the tollhouse (Step S3). Thereafter, the toll transfer information is exchanged between the mobile station 30 of the vehicle 28 and the fixed station 10. During these processes, the vehicle 28 continues running and when the entrance of the vehicle 28 is detected with the vehicle detector 24 (Step S4), the control unit 42 fetches the current time from a timer and stores the current time data in the vehicle passing time management table 46 (Step S5). At this time, the control unit 42 calculates the time and speed taken by the vehicle 28 to pass a section between the vehicle detectors 16 and 24, stores the calculation results in the vehicle passing time management table 46 and turns off the tollhouse stay flag (Step S6), to mark that the vehicle exited from the tollhouse (Step S7).

The control unit 42 updates the release timer time (value) in accordance with the passing times and speeds of other vehicles measured as the two traffic flow indices. The passing time and speed of each vehicle is measured in a vehicle measuring section between the vehicle detectors 16 and 24, i.e., the vehicle measuring section partially including the road in the communicable area of the fixed station 10 and mobile station 30.

In updating the release timer time in accordance with the passing times and speeds of other vehicles in the vehicle measuring section, the following calculation equation is used.

For example, the update calculation equation for the release timer value RLT is represented by:

$$RLT=RLTs\times(C1\times Tav/Ts) \quad (1)$$

where

RLTs: an initial set value (a value set in accordance with the vehicle measuring section passing time at a vehicle speed A);

C1: an adjustment parameter;

Tav: an average of vehicle passing times stored in the vehicle passing time management table 46 during a timer period; and Ts: a vehicle measuring section passing time at a vehicle speed A.

The important factor in the equation (1) is the vehicle passing time index Tav.

This equation (1) is an update calculation equation for the release timer value using the passing time. The release timer value may be updated by using the vehicle passing speed as the traffic flow index.

For example, Vav (an average of vehicle passing speeds stored in the vehicle passing time management table 46 during a timer period) may be used in place of Tav in the equation (1), and Vs (a vehicle measuring section passing speed) may be used in place of Ts in the equation (1). In this case, the equation (1) is replaced by the following equation (2):

$$RLT=RLTs\times(C2\times Vs/Vav) \quad (2)$$

In the above-described equations, the average passing time and speed in the timer period are used. Instead, the passing time and speed in the timer period may be extrapolated relative to the time axis.

A dynamic timer value may be determined by modifying the equation (1) as in the following:

$$RLT=RLTs+(C3\times Tav/Ts) \quad (3)$$

$$RLT=RLTs+(C4\times Vs/Tav) \quad (4)$$

In the equations (3) and (4), the definition of each parameter is the same as that for the equations (1) and (2), and replacement of the passing time index by the passing speed index is also the same as that for the equations (1) and (2).

Moving averages Tmav and Vmav of passing times and speeds in the timer period may also be used as in the following equations:

$$RLT=C5+Tmav \text{ or } RLT=C6\times Tmav \quad (5)$$

$$RLT=C7(C8-Vmav) \text{ or } RLT=C9/Vmav \quad (6)$$

In the equations (5) and (6), C7, C8 and C9 are adjustment parameters like those C1 to C4.

As described above, the most important factor in each of the various equations is the passing time or speed of a vehicle passing the vehicle measuring section.

In the above embodiment, the passing time and speed of a vehicle passing the vehicle measuring section is calculated by using the detection signals of the vehicle detectors 16 and 24. Instead, any twos of the vehicle detectors 16, 18 and 24 may be used to calculate the passing time and speed of a vehicle passing the section between the twos.

In this embodiment, although the entrance of a vehicle is used as the detection timing of the vehicle detectors 16, 18 and 24, the exit of a vehicle may be used or a combination thereof may also be used.

In the above embodiment, a single communicable area between the mobile station 30 and fixed station 10 is used. Instead, the single communicable area between the mobile station 30 and fixed station 10 may be divided into a plurality of communicable areas. In this case, toll transfer information is exchanged between the fixed station 10 and mobile station 30 when a vehicle enters one of the plurality of divided communicable areas, and the fixed station 10 measures the passing time or speed of each vehicle taken to pass a vehicle measuring section partially including the road belonging to each of the plurality of divided communicable areas. In this manner, the advantageous effects similar to the embodiment described above can be obtained.

According to the embodiment, the passing time and velocity of each vehicle passing the vehicle measuring section are measured by using two vehicle detectors provided to an automatic toll transfer system along a toll road and the like, and in accordance with the measured passing time or speed, the release timer value is updated. Accordingly, without adding new apparatus, the passing time and speed of a vehicle passing the vehicle measuring section can be established as the traffic flow indices in accordance with the detection signals of the two vehicle detectors, and the release timer value can be dynamically set.

What is claimed is:

1. A time management system for passing vehicles, comprising: mobile communication means mounted on a vehicle; fixed communication means for transferring toll transfer information to and from said mobile communication means mounted on the vehicle when the vehicle enters a communicable area; passing time measuring means for measuring a passing time of the vehicle passing a vehicle measuring section partially including a road belonging to the communicable area; and timer time setting means for setting a release timer time in accordance with a value measured by said passing time measuring means and adding the set release timer time to the toll transfer information, the release timer time indicating a communication inhibition time after completion of transfer of the toll transfer information, wherein said mobile communication means stops communication with said fixed communication means for the release timer time added to the toll transfer information after the completion of transfer of the toll transfer information to and from said fixed communication means, even if a communication link request is received from said fixed communication means.

2. A time management system for passing vehicles according to claim 1, wherein when said fixed communication means starts the transfer of the toll transfer information to and from said mobile communication means mounted on the vehicle and judges that communication is duplicate communication to a same vehicle in the communicable area, said fixed communication means forcibly stops the communication with the same vehicle.

3. A time management system for passing vehicles, comprising: mobile communication means mounted on a vehicle; fixed communication means for transferring toll transfer information to and from said mobile communication means mounted on the vehicle when the vehicle enters a communicable area; passing speed measuring means for measuring a passing speed of the vehicle passing a vehicle measuring section partially including a road belonging to the communicable area; and timer time setting means for setting a release timer time in accordance with a value measured by said passing speed measuring means and adding the set release timer time to the toll transfer information, the release timer time indicating a communication inhibition time after completion of transfer of the toll transfer information, wherein said mobile communication means stops communication with said fixed communication means for the release timer time added to the toll transfer information after the completion of transfer of the toll transfer information to and from said fixed communication means, even if a communication link request is received from said fixed communication means.

4. A time management system for passing vehicles according to claim 3, wherein when said fixed communication means starts the transfer of the toll transfer information to and from said mobile communication means mounted on the vehicle and judges that communication is duplicate communication to a same vehicle in the communicable area, said fixed communication means forcibly stops the communication with the same vehicle.

5. A time management system for passing vehicles, comprising: mobile communication means mounted on a vehicle; fixed communication means for transferring toll transfer information to and from said mobile communication means mounted on the vehicle when the vehicle enters one of a plurality of divided communicable areas; passing time measuring means for measuring a passing time of the vehicle passing a vehicle measuring section partially including a road belonging to each of the plurality of divided communicable areas; and timer time setting means for setting a release timer time in accordance with a value measured by said passing time measuring means and adding the set release timer time to the toll transfer information, the release timer time indicating a communication inhibition time after completion of transfer of the toll transfer information, wherein said mobile communication means stops communication with said fixed communication means for the release timer time added to the toll transfer information after the completion of transfer of the toll transfer information to and from said fixed communication means, even if a communication link request is received from said fixed communication means.

6. A time management system for passing vehicles according to claim 5, wherein when said fixed communication means starts the transfer of the toll transfer information to and from said mobile communication means mounted on the vehicle and judges that communication is duplicate communication to a same vehicle in the communicable area, said fixed communication means forcibly stops the communication with the same vehicle.

7. A time management system for passing vehicles, comprising: mobile communication means mounted on a vehicle; fixed communication means for transferring toll transfer information to and from said mobile communication means mounted on the vehicle when the vehicle enters one of a plurality of divided communicable areas; passing speed measuring means for measuring a passing speed of the vehicle passing a vehicle measuring section partially including a road belonging to each of the plurality of divided communicable areas; and timer time setting means for setting a release timer time in accordance with a value measured by said passing speed measuring means and adding the set release timer time to the toll transfer information, the release timer time indicating a communication inhibition time after completion of transfer of the toll transfer information, wherein said mobile communication means stops communication with said fixed communication means for the release timer time added to the toll transfer information after the completion of transfer of the toll transfer information to and from said fixed communication means, even if a communication link request is received from said fixed communication means.

8. A time management system for passing vehicles according to claim 7, wherein when said fixed communication means starts the transfer of the toll transfer information to and from said mobile communication means mounted on the vehicle and judges that communication is duplicate communication to a same vehicle in the communicable area, said fixed communication means forcibly stops the communication with the same vehicle.

* * * * *

UNITED STATES PATENT AND TRADEMARK OFFICE

CERTIFICATE OF CORRECTION

PATENT NO. : 6,218,963 B1
DATED : April 17, 2001
INVENTOR(S) : Toshihiro Kawanabe et al.

It is certified that error appears in the above-identified patent and that said Letters Patent is hereby corrected as shown below:

Title page,
After Item "[73] Assignee: Hitachi, Ltd., Tokyo (JP)" insert -- ; Hitachi Information & Control Systems, Inc., Hitachi-shi (JP) --.

Signed and Sealed this

Sixteenth Day of April, 2002

*Attest:*

*Attesting Officer*

JAMES E. ROGAN
*Director of the United States Patent and Trademark Office*